United States Patent [19]

Mustee

[11] 3,940,806

[45] Mar. 2, 1976

[54] FREE-STANDING SHOWER STALLS

[75] Inventor: Bernard Mustee, Cleveland, Ohio

[73] Assignee: E. L. Mustee & Sons, Inc., Cleveland, Ohio

[22] Filed: Jan. 3, 1975

[21] Appl. No.: 538,436

Related U.S. Application Data

[62] Division of Ser. No. 359,078, May 10, 1973, Pat. No. 3,895,398, which is a division of Ser. No. 158,927, July 1, 1971, Pat. No. 3,751,737, which is a division of Ser. No. 864,716, Oct. 8, 1969, Pat. No. 3,609,773.

[52] U.S. Cl. ..... 4/146; 4/145

[51] Int. Cl.[2] ..... A47K 3/22

[58] Field of Search ..... 4/145, 146–149, 4/152–155, 286, 288, 292, 252 R, 160, 164; D23/49, 57; 52/35; 285/205, 206, 272

[56] References Cited

UNITED STATES PATENTS

| | | | |
|---|---|---|---|
| 3,382,635 | 5/1968 | O'Gara et al. | 4/146 X |
| 3,462,771 | 8/1969 | Moretti | 4/146 |
| 3,606,618 | 9/1971 | Veech | 4/147 |
| 3,629,875 | 12/1971 | Dow | 4/146 |
| 3,757,358 | 9/1973 | Chisholm et al. | 4/146 |

*Primary Examiner*—Henry K. Artis

*Attorney, Agent, or Firm*—Watts, Hoffmann, Fisher & Heinke Co.

[57] ABSTRACT

A free-standing shower stall including a base, wall panels joined to the base, a rail connected to the wall panels to impart rigidity to the stall, and a drain connection in the base which permits the shower stall to be placed in any desired location. A shower stall as described wherein the wall panels are plastic and are joined together by imperforate, water tight hinges which permit the panels to be folded for shipment in association with other parts of the stall and to be easily erected during assembly.

4 Claims, 21 Drawing Figures

Fig. 16
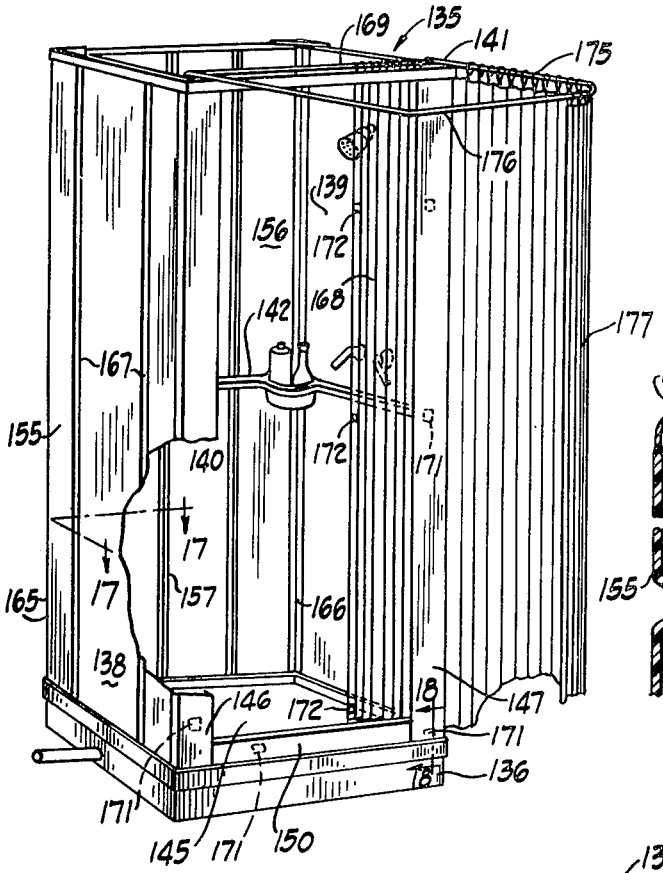
Fig. 17
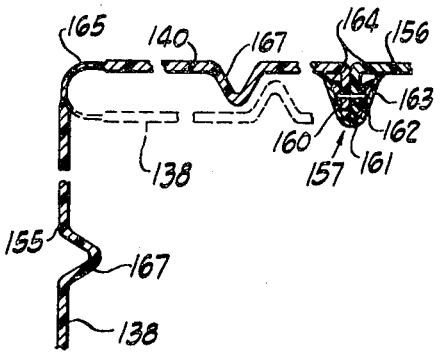
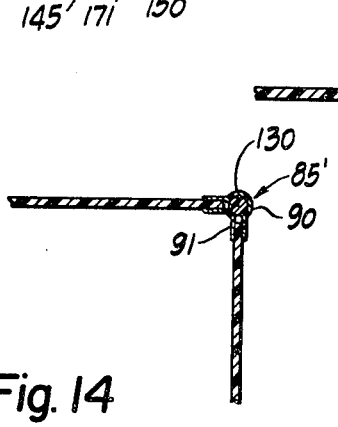
Fig. 14
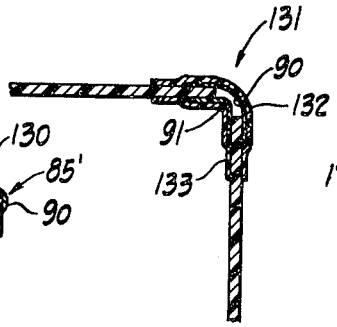
Fig. 15
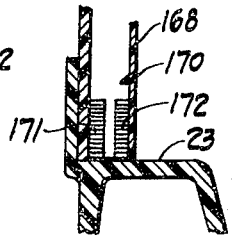
Fig. 18

FREE-STANDING SHOWER STALLS

CROSS-REFERENCED PATENTS

This application is a division of U.S. Pat. application Ser. No. 359,078, filed May 10, 1973 now U.S. Pat. No. 3,895,398, which in turn is a division of U.S. Pat. application Ser. No. 158,927, filed July 1, 1971, now U.S. Pat. No. 3,751,737, which in turn is a division of U.S. Pat. application Ser. No. 864,716, filed Oct. 8, 1969, and now U.S. Pat. No. 3,609,773.

SUMMARY OF THE INVENTION

The present invention relates generally to the construction of stall enclosures, and more specifically to a new free-standing shower stall structure.

An object of the invention is to provide a free-standing stall construction including a base, wall panels joined to the base, and a hand rail secured to the wall panels within the stall to impart rigidity.

Another object of the invention is to provide a new stall enclosure characterized by a light-weight construction which can be conveniently packaged for shipment and easily and quickly assembled.

A further object of the invention is to provide a new free-standing shower stall which can be easily installed at any desired location.

Another object of the invention is to provide a new free-standing shower stall including a base and a drain connection in the base which can be easily connected to a drain outlet in the floor of a building.

A further object of the invention is to provide a new free-standing shower stall having plastic wall panels connected by water-tight, imperforate hinges which permit the wall panels to be folded for shipment and easily and quickly assembled during installation of the stall.

In the preferred embodiment of the invention, the new free-standing stall comprises wall panels which are joined to a floor or base to define three sides of a rectangular enclosure. When assembled and erected, the rectangular stall is rigid and is adapted to the mounting of a door, such as a conventional shower door. The floor or base of the stall may be a molded one-piece construction to which the wall panels can be easily secured by conventional fasteners.

The rectangular shape of the new stall makes it convenient to locate in a building and is an improvement over conventional, semi-cylindrical stalls which do not lend themselves to the mounting of a door and which provide minimum stall area for a given amount of floor space.

An important feature of the invention resides in the provision of a hand rail which is secured to the wall panels within the stall. The hand rail is secured to the walls in such a manner as to impart rigidity to the stall so that it will not sway and so that the walls are prevented from bowing. The hand rail also is a safety measure and contributes to the convenient use of the new structure as a shower stall.

Another important feature of the invention resides in a novel drain structure which may be provided in the base and which can be conveniently connected to a waste or drain pipe. In the preferred embodiment, the drain structure comprises a drain body which is fitted through a hole in the base and is externally threaded so that a drain casting can be connected to the drain body below the base. A pipe is in turn connected to the drain casting to extend to an outlet drain of the floor on the building in which the stall is located.

The drain body and drain casting are constructed such that the connected pipe can extend in any direction from the stall, whereby the stall can be located in any desired position remote from the drain outlet. Further, the shower stall can be conveniently installed having the necessary plumbing connections without the necessity of having to remove any part of the building floor on which the shower stall is placed.

According to the preferred embodiment of the invention, the wall panels of the stall are formed by sheets of plastic, thereby making the new stall resistant to corrosion which has been a problem with conventional metal stall constructions. The plastic wall panels are joined along their vertical edges by imperforate, leak-proof hinges, which eliminate the need for conventional metal fasteners or the like. The hinged formation of the plastic wall panels lends to the ease with which the new stall can be assembled.

Still another feature of the invention resides in the convenient and inexpensive manner in which the shower stall can be packaged for shipment. The preferred hinged formation of the plastic wall panels permits the wall panels to be folded for shipment in association with other components of the stall.

Other objects and advantages of the invention will become apparent from the following detailed description taken in conjunction with the accompanying drawings.

BRIEF DESCRIPTION OF THE DRAWINGS

FIG. 14 is a cross-sectional view similar to FIG. 5 showing another preferred construction of a hinge between walls of the stall of FIG. 1;

FIG. 15 is a cross-sectional view similar to FIG. 5 showing still another preferred construction of a hinge between walls of the stall of FIG. 1;

FIG. 16 is a perspective view of another preferred embodiment of the present invention;

FIG. 17 is a cross-sectional view of a portion of the shower stall of FIG. 16 as seen from the plane indicated by the line 17—17 of FIG. 16 and having parts broken away;

FIG. 18 is a cross-sectional view as seen from the plane indicated by the line 18—18 of FIG. 16;

DESCRIPTION OF PREFERRED EMBODIMENTS

Figure 1:
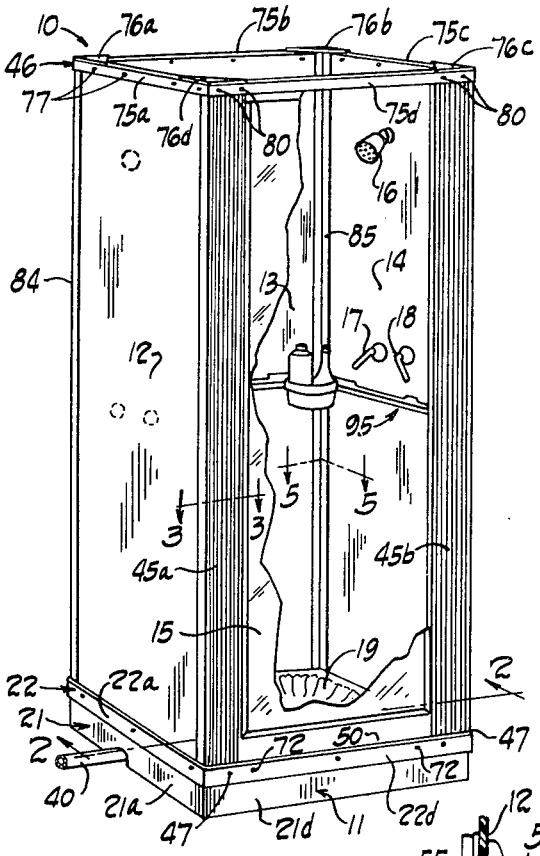
FIG. 1 is a perspective view of a shower stall according to a preferred embodiment of the present invention.

FIG. 1 illustrates a prefabricated shower stall 10 constructed according to a preferred embodiment of the present invention. The shower stall 10 includes a base 11 vertically extending wall panels 12, 13, 14, and a conventional shower door 15. A suitable shower nozzle 16 extends through the wall 14 as do valve handles 17, 18 for controlling the flow and temperature of water sprayed from the nozzle 16. The nozzle 16 and handles 17, 18 are adapted to be connected to conventional plumbing which is not illustrated.

Figure 2:
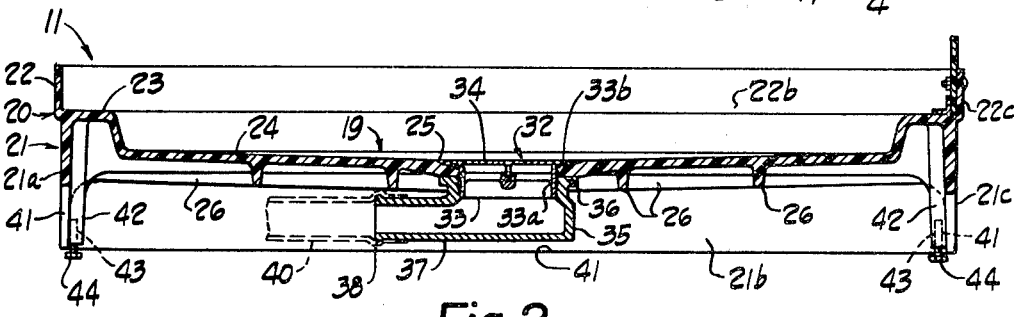
FIG. 2 is a cross-sectional view as seen from the plane indicated by the line 2—2 of FIG. 1.

The base 11, FIG. 2, is preferably a molded construction of fiber reinforced plastic and includes a generally rectangular central body portion 19 which defines the floor of the shower stall and an integral, peripheral flange structure 20. The flange structure 20 includes a downwardly extending support flange 21 formed continuously about the periphery of the body portion 19 and an upwardly extending wall supporting flange 22. The support flange 21 has portions 21*a–d* extending downwardly at the respective sides of the base 11 and the wall supporting flange 22 has portions 22*a–d* extending upwardly from the respective sides of the base. If desired, leveling legs may be provided at the corners of the flange portions 21*a—d.*

The body portion 19 of the base 11 has a raised, peripherally extending ledge portion 23 adjacent the flange structure 20 and a floor defining portion 24 which slopes toward a central drain opening 25. Suitable supporting ribs 26 are molded in the base 11 beneath the floor portion 24 and the ledge 23 to provide strength and rigidity.

A drain structure 32 is mounted through the drain opening 25. As shown, the drain structure 32 includes a drain body 33 having a cylindrical threaded portion 33*a* projecting below the floor 24 and an upper flanged portion 33*b* flush with the floor surface. A strainer 34 may be disposed across the mouth of the member 33 flush with the floor. The drain structure 32 also includes a drain casting or fitting 35 in the form of an elbow. The threaded portion 33*a* is threaded into the drain fitting and the fitting 35 has an upper flange 36 engaging the bottom side of the floor 24 when the drain body 33 and the fitting 35 are threaded together. Suitable calking or gaskets can be disposed between the floor and the drain elements if desired.

The fitting 35 has a generally horizontally extending arm 37 having a peripheral bead 38 at its end. A plastic pipe 40 (shown in the broken lines in FIG. 2) is forced over the bead 38 so that the pipe is tightly maintained on the arm 37. In the preferred construction, the flange 20 of the base 11 is of a sufficient height to permit the drain pipe 40 to extend horizontally below the floor 24 through a notch 41 in a selected one of the flange portions 21*a–d.* The preferred manner of connecting the fitting 37 to the base by the drain body 32 enables the stall 10 to be installed at a location spaced from the waste pipe (not shown) to which the pipe 40 extends.

Since the fitting 35 and the drain body 33 are threaded together the fitting can be oriented to extend in any desired direction to facilitate installation. Further, the shower stall 10 can be installed without the necessity of tearing up any part of the floor which supports the stall. If desired, the base 11 can be placed directly over the waste pipe and the side connection provided by the fitting 35 eliminated.

The door 15 is hung on a frame including a pair of extruded aluminum structural members 45*a*, 45*b* which are attached to the flange portion 22*d* of the base 11 by screws 47 and extend upwardly to a support frame 46. The frame for the door 15 additionally includes a sill 50 which extends between the members 45*a*, 45*b* along the flange portion 22*d.*

Figure 3:
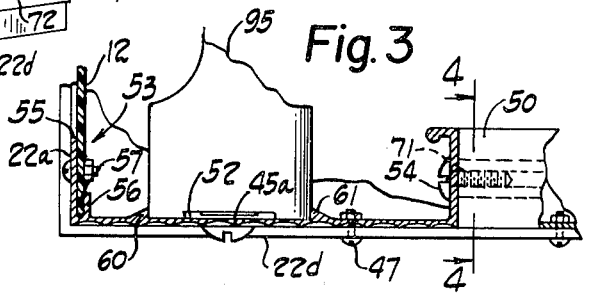
FIG. 3 is a cross-sectional view as seen from the plane indicated by the line 3—3 of FIG. 1 and shown on a scale which is larger than the scale of FIG. 1.

As best seen in FIG. 3, the vertical door frame member 45*a* is generally channel shaped in cross-section and includes a web 52, a flange 54 along one side of the web and a pair of parallel flanges 55, 56 along the other side of the web. The flanges 55, 56 are spaced apart to define a groove 57 adapted to receive the edge of the wall panel 12. The flanges 54–56 extend inwardly of the shower stall from the web. Parallel rib portions 60, 61 extend along the web between the flanges 55, 56 and the flange 54.

Figure 4:
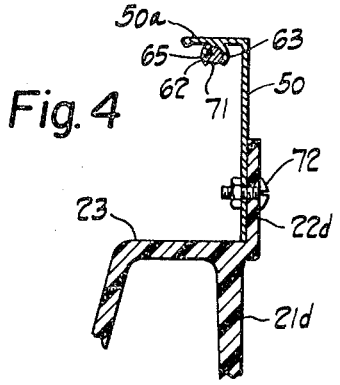
FIG. 4 is a cross-sectional view as seen from the plane indicated by the line 4—4 of FIG. 3.
Figure 5:
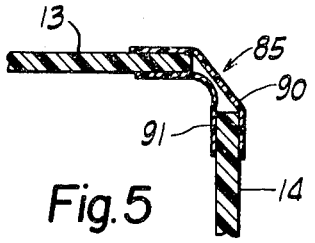
FIG. 5 is a cross-sectional view as seen from the plane indicated by the line 5—5 of FIG. 1.

The sill 50 is an extruded member having a generally L-shaped cross-section shape which is supported in an inverted position across the threshold of the door. The horizontal leg 50*a* of the sill is formed with downwardly projecting projections 62, 63 which are semicircular in cross-section, are disposed in facing relationship to define a nearly cylindrical space or opening 65 between them. The flange 54 is provided with an opening 70 alignable with the opening 65 on the leg 61 of the sill 50, FIG. 4. A self-tapping screw 71 extends through the opening 70 and is threaded into the sill 50. The vertical leg of the sill 50 is connected to the flange 22*d* on the base 11 by fasteners 72 extending through the flange 22*d* and leg of the sill 50.

The door frame member 45*b* is constructed and mounted substantially in the same manner as illustrated and described in connection with the member 45*a* except for the inclusion of a conventional hinge construction for supporting the door 15.

The support frame 46 at the top of the stall 10 includes sheet metal angle members 75*a–d* which are disposed along the upper edges of the walls 12, 13, 14 and the door 15, respectively. The members 75 are mitered at their ends and are secured together by triangular gusset plates 76*a–d* which insure rigidity of the frame 46. In the preferred construction the frame 46 is assembled by the manufacturer and mounted on the stall 10 as a unit.

The walls 12–14 are secured to their respective frame members 75*a–c* by screws 77 extending through the vertical leg of each frame member and the associated wall. The members 45*a*, 45*b* of the door construction are similarly fastened to the frame member 75*d* by screws 80.

The walls 12–14 are each constructed from a rectangular, relatively thin planar sheet of plastic material extending continuously between the base 11 and frame 46. In a preferred construction the walls are defined by sheets of fiberglass reinforced polyester resin about 0.065 inches thick. Each wall is formed with appropriately located "knockouts" which can be dislodged to define openings for receiving the shower nozzle and valve handles. Thus the stall 10 can be located and oriented as desired with respect to existing plumbing and only the knockouts in one wall need be removed.

The walls 12, 14 are tightly received in the grooves 57 formed in the members 45*a*, 45*b*, respectively (FIG. 3), at the sides of the walls adjacent the door 15 and the walls are bolted to these flanges. The lower edges of the walls rest on the ledge 23 of the base 11 and are tightly maintained against the flanges 22*a–d* by screws extending through the flanges and walls.

The walls 12–14 are connected together by imperforate hinges 84, 85 which are assembled with the walls prior to connecting the walls to the base. The hinges are identical and therefore only the hinge 85 is described in detail. As shown in FIGS. 5–8 the hinge 85 is defined by two strips of plastic tape 90, 91. The strip 91 forms an interior corner of the shower stall extending continuously between the walls 13, 14 while the strip 90 extends between the walls 13, 14 at the juncture of those walls on the exterior of the shower stall. The plastic tape must be of a nonstretching character capable of remaining firmly adhered to the walls when exposed to hot water at temperatures up to about 140°F. Tapes which have been found satisfactory are a vinyl tape known commercially as "Devon" 120v sold by the Devon Tape Corporation and a polyester film tape No. 850 sold by the 3M Company.

The strips 90, 91 are provided with an adhesive of a character which insures that each strip is bonded securely to the walls 13, 14 and to the other tape strip where overlapping occurs. The adhesive is insoluble in water and since the strips 90, 91 are imperforate, a permanent, flexible water-tight joint is formed between the sides.

Figure 6:
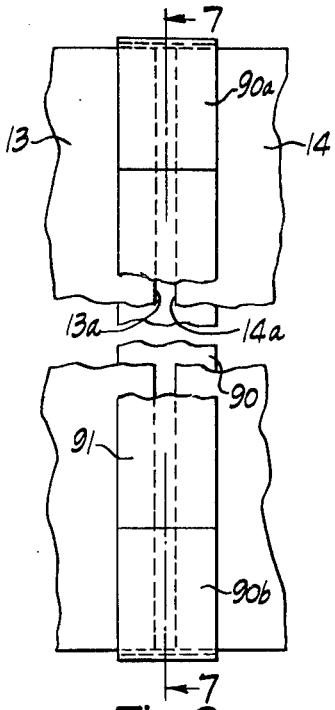
FIG. 6 is a plan view of a preferred hinge construction connecting walls of the stall having portions broken away and with the walls laid flat.
Figure 7:
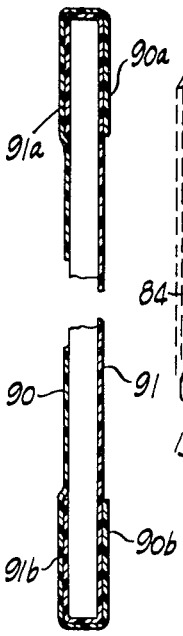
FIG. 7 is a cross-sectional view as seen from the plane indicated by the line 7—7 of FIG. 6.

The method of constructing the hinge 85 is best seen in FIGS. 6 and 7. As shown in FIG. 6 the walls 13, 14 are placed side by side with adjacent sides 13*a*, 14*a* spaced slightly apart; for example, the walls may be laid flat on a floor. The tape strip 91 is of greater length than the sides 13*a*, 14*a* and is attached to the walls 13, 14 continuously along their interior (upwardly facing) faces, bridging the space between them. The end portions 91*a*, 91*b* of the strip 91 extend around the upper and lower sides of the walls 13, 14 and are bonded to the exterior of the walls.

The wall can then be turned over and the tape strip 90 is applied. The tape strip 90 is substantially the same length as the strip 91 and bridges the sides 13*a*, 14*a* along the exterior faces of the walls. The end portions 90*a*, 90*b* overlie the ends 91*a*, 91*b* of the strip 91 and extend around the upper and lower sides of the walls 13, 14 and along the strip 91 on the interior faces of the wall.

Figure 8:
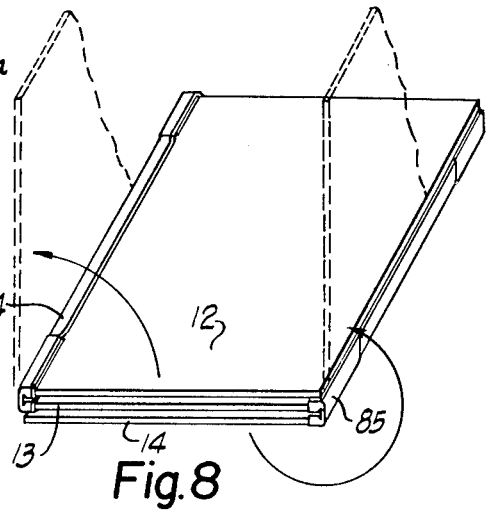
FIG. 8 is a perspective view of the walls of the enclosure of FIG. 1 folded for shipment.
Figure 10:
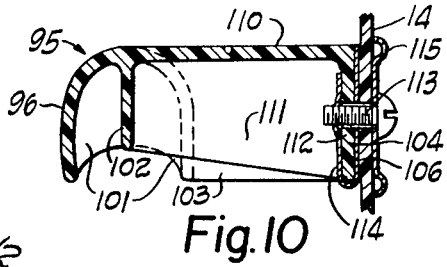
FIG. 10 is a cross-sectional view seen approximately from the plane indicated by the line 10—10 of FIG. 9 and shown on a scale which is larger than the scale of FIG. 9.

The sides 13*a*, 14*a* are spaced apart sufficiently to enable folding the walls 13, 14 into confronting relationship (see FIG. 8). This enables efficient shipping and storage of the walls, with the hinges intact, as is described in more detail presently.

Figure 9:
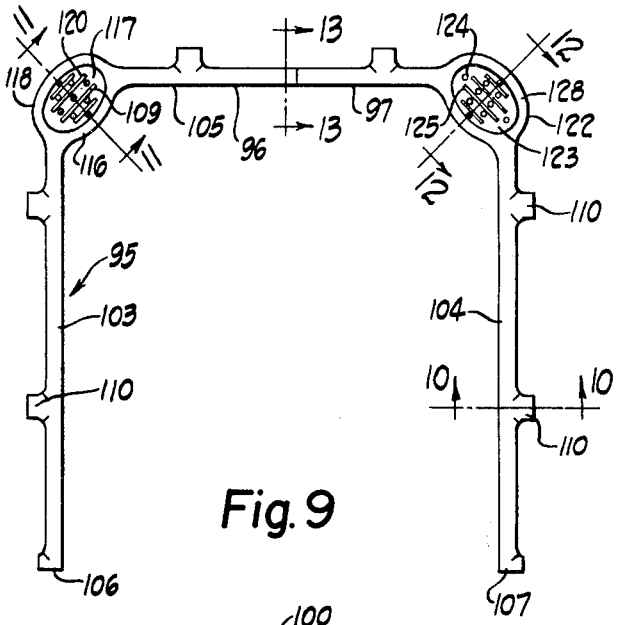
FIG. 9 is a plan view of a support rail for the walls of the stall of FIG. 1 which serves as a hand rail.

A support rail 95 extends about the interior of the shower stall to rigidly support the walls 12–14 intermediate their upper and lower ends. The construction of the rail is illustrated in FIGS. 9–13. FIG. 9 shows the rail to be constructed of two parts 96, 97 connected together to form a U-like rail. The parts 96, 97 are each L-shaped, as viewed in plan, and the short legs of each L terminate in tubular sections 100, 101 respectively. These tubular sections are D-shaped in cross-section, see FIG. 13, and the section 100 is telescopically received in the section 101 to secure the parts 96, 97 together and provide a rigid unitary rail construction. A rivet 98 is provided to maintain the sections 100, 101 in position.

The rails proper are generally semi-circular in cross-section with the open side facing downwardly. A reinforcing rib 102 is formed in the rail and extends longitudinally of the rail parallel to the downwardly extending sides.

The rail 95 is rigidly connected to the walls 12–14 and structural members 45*a*, 45*b*. The rail 95 is disposed in the shower stall to form side wall portions 103, 104 and a rear wall portion 105 extending along the side and rear walls of the stall, respectively. The projecting ends 106, 107 of the rail are bolted to the structural members 45*a*, 45*b* as shown in FIG. 3. In the preferred construction "Speed Nuts" are fixed to the ends 106, 107 for receiving the bolts.

The ends 106, 107 of the rail 95 are received between the ribs 60, 61 on the associated frame member. The ends 106, 107 are tightly received between the ribs (FIG. 3) and thus the ribs rigidly maintain the ends square with respect to the frame members.

In addition to supporting the walls of the shower stall the rail 95 is constructed to provide a hand rail. The rail 95 thus includes integral support arms 110 extending between the rail portions 103–105 and their adjacent walls. The arms 110 are generally semicircular in cross-section opening downwardly and each is provided with a pair of longitudinal stiffening ribs 111 extending from the rib 102 to a support flange 112 formed on the arm. The support flange 112 is provided with an opening for receiving a bolt 113 extending through the wall of the shower stall so that the arms 110 are rigidly attached to the walls of the stall. In the preferred construction "Speed Nuts" 114 are clamped to the arms 110 for reception of the bolts 113. In order to distribute the holding forces of the bolts 113, washers 115 are carried on the bolts. The washers are urged into engagement with the walls by the heads of the bolts.

Figure 11:
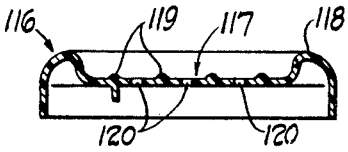
FIG. 11 is a cross-sectional view seen from the plane indicated by the line 11—11 of FIG. 9 and shown on a scale which is larger than the scale of FIG. 9.
Figure 12:
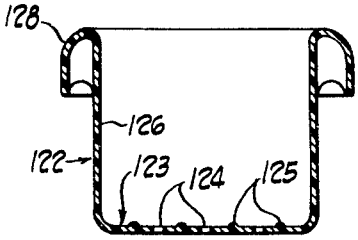
FIG. 12 is a cross-sectional view seen from the plane of the line 12—12 of FIG. 9 and shown on a larger scale then that of FIG. 9.
Figure 13:
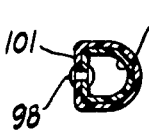
FIG. 13 is a cross-sectional view seen from the plane indicated by the line 13—13 of FIG. 9 and shown on a larger scale.

In addition to the support and hand rail functions, the rail 95 provides suitable receptacles for soap, bottles and so forth within the stall. As is seen in FIGS. 9 and 11 a soap dish 116 is integrally formed in the rail 95 at one corner of the shower stall. The soap dish 116 includes a generally oval support section 117 surrounded by a lip construction 118 which merges into the side and rear rail portions 103, 105 respectively. The support 117 has a generally planar surface with a series of parallel longitudinal ribs 119 projecting upwardly from the surface for supporting soap above the surface. A series of drain openings 120 are provided in the support 117 on opposite sides of each rib to assure water drainage.

A bottle receptacle 122 is integrally formed between the side and rear rail portions 104, 105, respectively, and includes a generally oval support section 123 having drain openings 124 and ribs 125 which function in the manner described above in reference to the soap dish 116. The support 123 is surrounded by a continuous side wall 126 which merges into an upper lip construction 128. The lip 128 is of substantially the same construction as the lip 118 of the soap dish 116. The side wall 126 is preferably about 3 inches in height to provide adequate lateral support for bottles, tubes, etc. which may be placed in the receptacle.

FIG. 14 illustrates another preferred hinge construction 85' for the shower stall. The hinge construction 85' is substantially the same as the hinge construction described in reference to FIG. 5 except that a cylinder 130 of sponge vinyl material extends the entire length of the walls between adjacent sides. The sponge cylinder 130 is adhered to the tape strips 90, 91 and has a diameter approximately twice the thickness of the walls.

When the shower stall is assembled utilizing the hinge construction 85' the cylinder 130 provides a bead-like appearance at the corners of the walls and supports the tape strips. When the shower stall is assembled for shipping, as illustrated in FIG. 8, the cylinders 130 cushion the sides of the walls to prevent possible damage to them or to the tape during shipment.

In some circumstances, it is desirable to reinforce the tape forming the hinges against gouging which can result in the formation of holes through the tape strips 90 and 91. Should the tape strip 91 be holed, water could accumulate between the walls of stall at their junctures, and leak from the stall.

FIG. 15 illustrates a modified hinge construction 131 substantially like the hinges 84, 85, but which is reinforced to avoid the possibility of holing the plastic tape strips. The illustrated hinge construction 131 includes reinforcing tape strips 132, 133, which are preferably composed of synthetic fibers for example Rayon, which carry a suitable adhesive. A preferred tape is a bidirectional Rayon fiber tape sold by Behr-Manning and known as No. 295 Behr strapping tape.

To construct the hinge 131, the walls are laid flat and the reinforcing tape strips 132, 133 are adhered to the walls in the same manner as described above in reference to applying the tape strips 90, 91 (FIGS. 6–8). The tape strips 90, 91 are then applied over the strips 132, 133.

As shown in FIG. 15 the tape strips 90, 91 are considerably wider than the reinforcing strips 132, 133 so that the junctures of the walls are sealed by the strips 90, 91 which firmly adhere to the walls and to the reinforcing strips. The reinforcing strips coextend with the strips 90, 91 across the space between the sides of the walls and because of the toughness of the reinforcing tape, sharp objects are not likely to penetrate the plastic tape strips 90, 91.

Although FIG. 15 illustrates two reinforcing tape strips in the hinge, it is contemplated that a single reinforcing strip can be employed. This strip preferably coextends with the plastic strip 90 at the outside of the shower stall.

Referring now to FIG. 16, another preferred shower stall 135 is shown. The stall 135 includes a base 136 supporting a drain construction and three walls 138–140. A wall supporting frame 141 extends about the upper ends of the walls and an access opening 145 is defined by a pair of vertical support members 146, 147 which extend from the base 136 to the upper support frame 141. A sill 150 extends between the vertical supports and is connected to the base.

The walls 138–140 of the shower stall 135 are defined by two sheets 155, 156 of plastic material which are connected together at a joint 157, FIG. 17, extending vertically along the center of the rear wall 140. The joint 157 is formed by inwardly extending wall flanges 160, 161 which engage each other along the joint. The flanges 160, 161 are connected by a plurality of staples 162 which extend through and grip the flanges at spaced locations along the joint. Only one staple is illustrated in FIG. 16.

The joint 157 is sealed to prevent water leakage between the flanges. Preferably the joint is covered by a suitable plastic or rubber seal 163 extending the length of the joint on the inside of the stall. The seal includes resilient lips 164 which grip the staples to maintain the seal in position over the flanges.

The walls 138–140 of the shower stall are folded flat for shipment after the joint 157 is constructed and accordingly the walls are joined by hinges 165, 166. The hinges 165, 166 are provided in each sheet 155, 156 of the plastic wall material at the corners so that the walls 138, 139 are foldable toward each other over the rear wall 140.

The hinges 165, 166 are each integrally formed of the wall material and provide what is termed a "live" hinge between adjacent walls. These hinges are defined by reduced sectional thicknesses of the material defining junctions of the walls and are considerably more flexible than the walls proper. The plastic material defining the walls is polypropylene, or the equivalent, and the properties of this material are such that the hinges freely flex to provide the "live" hinge between the walls. In the illustrated shower stall, vertical support ribs 167 are defined in the walls to provide rigidity. The wall 138 is illustrated folded upon the wall 140 by broken lines in FIG. 17.

The access opening 145 is closable by a shower curtain 168 is suspended from a bar 169 connected between gusset plates of the upper support frame 141. The free end and sides of the shower curtain are suspended adjacent the vertical supports and the sill when the curtain is closed. The marginal portions of the curtain are anchored in place by fuzz latches 170 (FIG. 18) disposed at spaced locations along these portions of the curtain. Each latch includes a pad 171 of fibrous latching material attached to the members 146, 147 and the sill 150, and a pad 172 of fibrous latch material attached to the shower curtain. Fibers of one pad define resilient hook-like elements while fibers of the other pad form loops. When the pads are pressed together, hooks and loops engage to detachably anchor the curtain in place.

The shower stall 135 additionally includes a curtained dressing area. A generally U-shaped rod 175 has its end connected to gusset plates on the upper frame 141 on opposite sides of the opening. The bight 176 of the rod 175 projects horizontally away from the access opening. A shower curtain 177 is suspended from the rod 175 by suitable clips permitting the curtain to be drawn about the rod 175. When the curtain 177 is drawn a substantially enclosed dressing area is provided immediately in front of the access opening. The shower stall 10 of FIG. 1 can also be provided with dressing area if desired.

Figure 19:
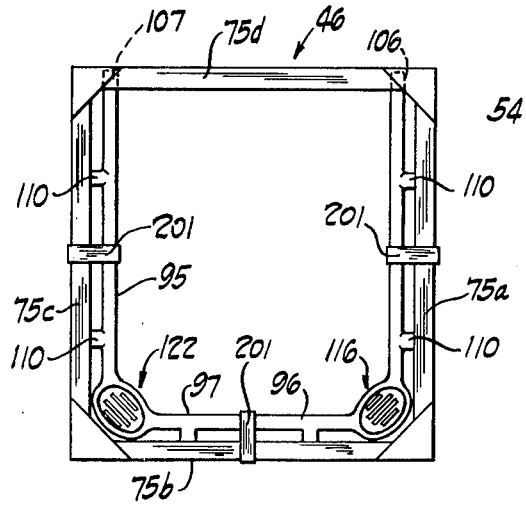
FIG. 19 is a plan view of parts of the stall which are assembled for shipment.
Figure 21:
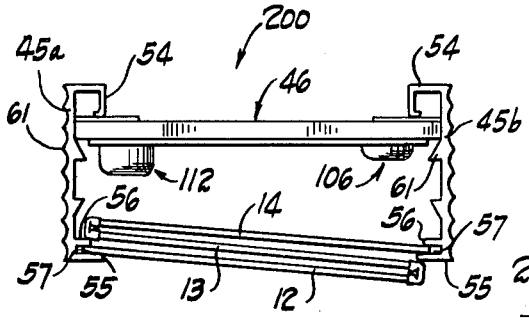
Figure 20:
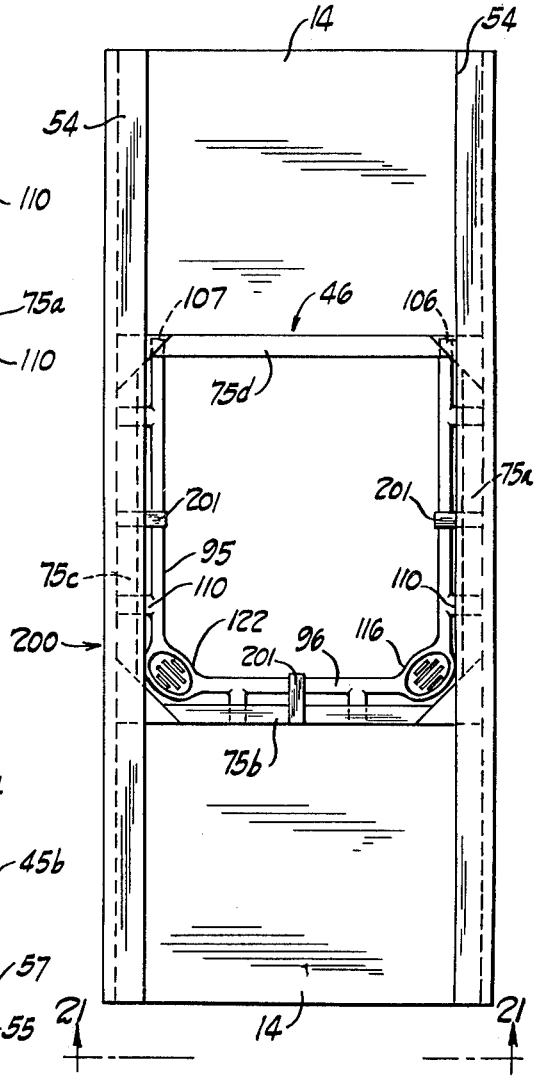
FIG. 20 is a plan view of the assembled parts of FIG. 19 and additional parts of the shower stall which are assembled to form a shipping package; and, FIG. 21 is a view seen from the plane indicated by the line 21—21 of FIG. 20.

FIGS. 19–21 illustrate parts of the shower stall 10 organized into an assemblage 200 for insertion in a shipping container. The shower stall components, except for the base or floor 11, are assemblable to occupy a flat rectangular volume for efficient shipping of the parts and wherein the parts are protected against damage during transit.

As seen in FIG. 19 the frame 46 and the handrail 95 are assembled together by tape strips 201 so that the handrail 95 is supported within the frame assembly.

The support frame members 45a, 45b are then laid out parallel to each other with the flanges 54 and 55, 56 extending toward each other. The walls are folded upon each other as shown in FIG. 8. The free side of one wall, e.g., the wall 12, is inserted into the groove 57 in the frame member 45*a*. The free side of the wall 14 is inserted in the groove 57 in the frame member 45*b*. The walls fit tightly in the grooves 57 so that the assemblage of the walls and frame members is maintained without additional fasteners or other securing devices.

The hinge between the walls 12, 13 is located above the flanges 55, 56 of the frame member 45*a* while the hinge between the walls 13, 14 is positioned below the flange 55 of the frame member 45b. Since the walls 12–14 are folded into confronting relationship the assemblage of the frame members and folded walls is easily inserted in a rectangular shipping container.

When the walls and frames are assembled the frame and handrail are slid between the frame members 45*a*, 45*b*. As seen in FIGS. 20 and 21 the frame 46 and handrail 95 are supported in position between the flanges 54 and the ribs 61 of each frame members.

The ribs 61 and flanges 54 are spaced apart so that the frame 46 is snuggly received between the flange 54 and rib 61 of each frame member. This prevents marring of the frame 46 during shipment as a result of shifting position or rattling. This construction further insures that the frame 46 and handrail do not contact the folded walls during shipment which could otherwise result in damage to the walls.

The sill 50 may also be taped to the interior of one of the frame members for shipment, and, if desired, the door 15 (not shown in FIGS. 19–21) may be placed in a protective carton and inserted in the space between the frame members 45a, 45b above the folded walls.

Although the invention has been described in its preferred forms with a certain degree of particularity, it is understood that the present disclosure of the preferred forms has been made only by way of example and that numerous changes in the details of construction and arrangement of parts may be resorted to without departing from the spirit and the scope of this invention.

What is claimed is:

1. An assemblage of parts of a self-standing shower stall for insertion in a shipping container comprising:

a. first and second parallel extending frame members each having a generally U-shaped cross-section;

b. each of said frame members defining a longitudinal slot, and said members oriented with said slots opening toward each other;

c. walls of said shower stall extending between said frame members and supported thereby; and, d. a side of a wall extending into and engaged with a slot in said first frame member and a side of a wall extending into and engaged with the slot in said other frame member.

2. An assemblage as claimed in claim 1 wherein three walls are supported by said frame members, a first wall engaged in said slot of said first frame member, a third wall engaged in said slot in said second frame member and said first and third walls flexibly connected to a second wall disposed between and coextending with said first and third walls.

3. An assemblage as claimed in claim 1 and further including at least one wall supporting member disposed between said first and second frame members, said first and second frame members each including a rib supporting said wall supporting member in position between said frame members and spaced from said walls.

4. An assemblage as claimed in claim 3 wherein ribs on each of said frame members extend parallel to a leg of said U-shaped cross-section of said frame member and a side of said at least one wall supporting member is nested between said leg and said rib.

* * * * *